US005337807A

United States Patent [19]

Ryan

[11] Patent Number: 5,337,807

[45] Date of Patent: Aug. 16, 1994

[54] FLOW DEPENDENT FINNED TUBE

[75] Inventor: Jerry E. Ryan, Tulsa, Okla.

[73] Assignee: Fintube Limited Partnership, Tulsa, Okla.

[21] Appl. No.: 34,471

[22] Filed: Mar. 19, 1993

Related U.S. Application Data

[63] Continuation-in-part of Ser. No. 927,015, Aug. 10, 1992, Pat. No. 5,240,070.

[51] Int. Cl.[5] ..... F28F 13/02

[52] U.S. Cl. ..... 165/146; 165/184

[58] Field of Search ..... 165/146, 184

[56] References Cited

U.S. PATENT DOCUMENTS

| | | | |
|---|---|---|---|
| 2,122,504 | 7/1938 | Wilson | 165/184 |
| 4,538,677 | 9/1985 | Bódás et al. | 165/146 |
| 4,763,726 | 8/1988 | Failing | 165/146 |
| 5,031,694 | 7/1991 | Lloyd | 165/184 |

*Primary Examiner*—Allen J. Flanigan

*Attorney, Agent, or Firm*—William S. Dorman

[57] ABSTRACT

The present invention is based upon the recognition that three different zones of heat transfer conditions exist on a finned tube:

1. The upstream zone (portion) of the finned tube that is initially exposed to the fluid flowing from a given location;
2. Zones that include the areas on opposite sides of the finned tube where the fluid flows around the finned tube and across (through) the fins; and
3. A zone that is located on the trailing edge of the finned tube (opposite from the first zone).

The invention recognizes that the fluid flowing conditions (temperature, pressure and velocity) are different at each of the three zones. Because of this difference the invention is the use of a different fin configuration and/or geometry in each of the zones that are conducive to the heat transfer for the fluid flow condition encountered at each zone, thus increasing the heat transfer capability of the fins.

7 Claims, 8 Drawing Sheets

FLOW DEPENDENT FINNED TUBE

This is a continuation-in-part application of co-pending application Ser. No. 07/927,015 filed Aug. 10, 1992, now U.S. Pat. No. 5,240,070.

BACKGROUND OF THE INVENTION

1. Field of the Invention

The present invention involves a recognition that there are three substantially different flow conditions or zones encountered by a finned tube and that these three different zones translate into three different heat transfer conditions; that is, assuming that a finned tube is subjected to fluid flowing from a given location and in a constant direction towards and past the finned tube, the upstream portion of the fluid flow will contact the leading edge of the fin so as to flow in an inward radial direction and at a relatively higher pressure thereby constituting a first zone; a second zone includes the areas on opposite sides of the tube where the fluid flows around the tube and across the fins substantially tangent to the side of the tube and at a pressure intermediate that of the first and third zones; a third zone is located on the trailing edge of the fin (opposite from the first zone) where the fluid moves also in a generally (outward) radial direction but with swirling vortices and relatively lower pressure.

Based upon the recognition that these three zones with their three different heat transfer conditions do indeed exist, the present invention involves enhancement (or no enhancement) of the fin in these three different zones. The fin is preferably configured differently in each zone to enhance heat transfer at the flow condition encountered in each zone. As will hereinafter appear, the fin can be serrated in a given zone, or enhanced in a given zone, or enhanced and serrated in a given zone. If it is desired to utilize an enhanced serrated fin, several different types of enhanced serrated fins are described in the above-mentioned co-pending application. One possible fin configuration to be used in one of the three zones is the elimination of the fin itself (a "no fin" configuration) if the flow rate and/or heat transfer rate is low enough and material or weight savings can be achieved.

2. The Prior Art

Heat exchange tubes are employed in a process heater or boiler. The function of the tubes is to transfer heat from spent fuel gases such as hot flue gases flowing across the outside of the tubes to a liquid, generally water or a hydrocarbon, circulating inside the finned tubes. The heated liquid is used to operate a turbine or used for other process purposes.

The transfer of thermal energy, i.e. heat, through the tube should be as efficient as possible so the amount of fuel used can be reduced. For these reasons, finned tubes are used because the fins on the tubes increase the exterior surface area of the tubes and thus increase their heat transfer capability. In reality, the recurring cost of fuel is always minimized, so the economic benefit is to reduce the cost of the equipment itself.

The exterior surface areas of prior art finned tubes have been increased by at least two means: i.e., spacing the fins closer together and providing higher fins. However, with respect to the "three zones" of the present invention, all prior art approaches towards improving the efficiency of finned tubes have involved the same style of surface in all three zones.

SUMMARY OF THE INVENTION

The present invention is an enhanced finned tube comprising fins having three zones with different surfaces or surface patterns thereon to accommodate heat transfer for the three substantially different fluid flow conditions encountered by the finned tube.

DETAILED DESCRIPTION OF THE PREFERRED EMBODIMENTS

Figure 2:
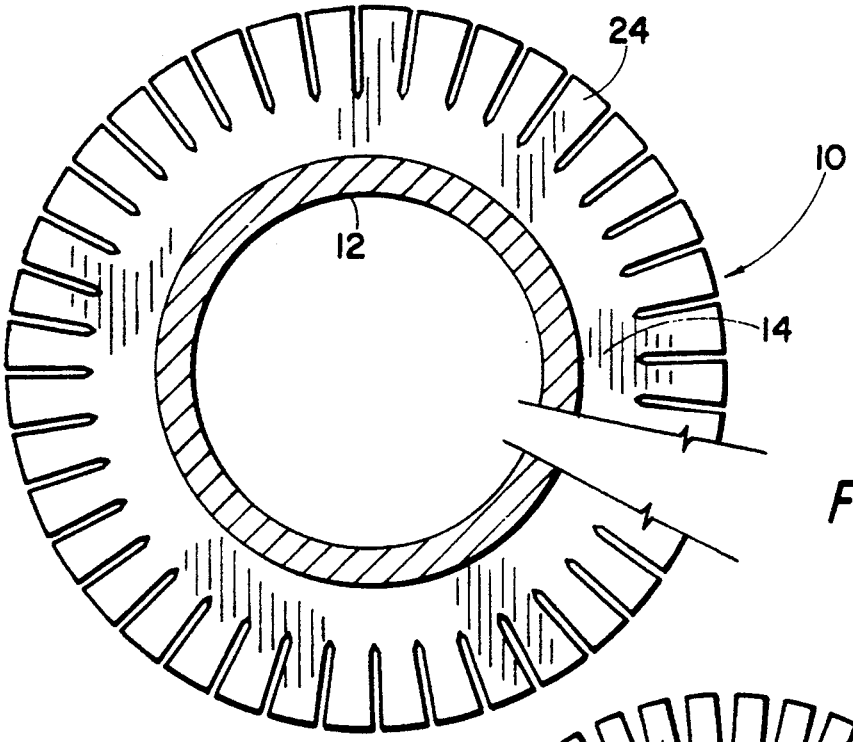
FIG. 2 is a cross-sectional view taken along line 2—2 of FIG. 1.
Figure 3:
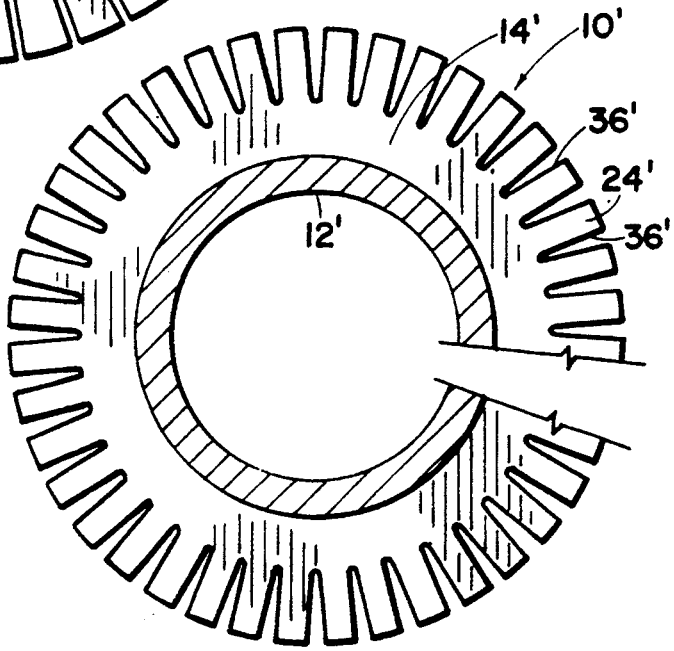
Fig. 3 (PRIOR ART)
FIG. 3 is a cross-sectional view of a prior art serrated finned tube, similar to the view of the enhanced serrated finned tube shown in FIG. 2.

Referring now to FIGS. 1 and 2 and 29 through 33, the present invention includes a finned tube 10 which is comprised of a central hollow tube 12 with a fin 14 attached thereto, usually by welding and preferably by high frequency resistance welding. The fin 14 extends outwardly from and is within 15 degrees of the perpendicular with the tube 12. The fin 14 is also wrapped helically around the tube 12 with adjacent spirals of the fin 14 spaced apart from each other. The fin 14 may be constructed of carbon steel, nickel alloys or other suitable material.

Figure 29:
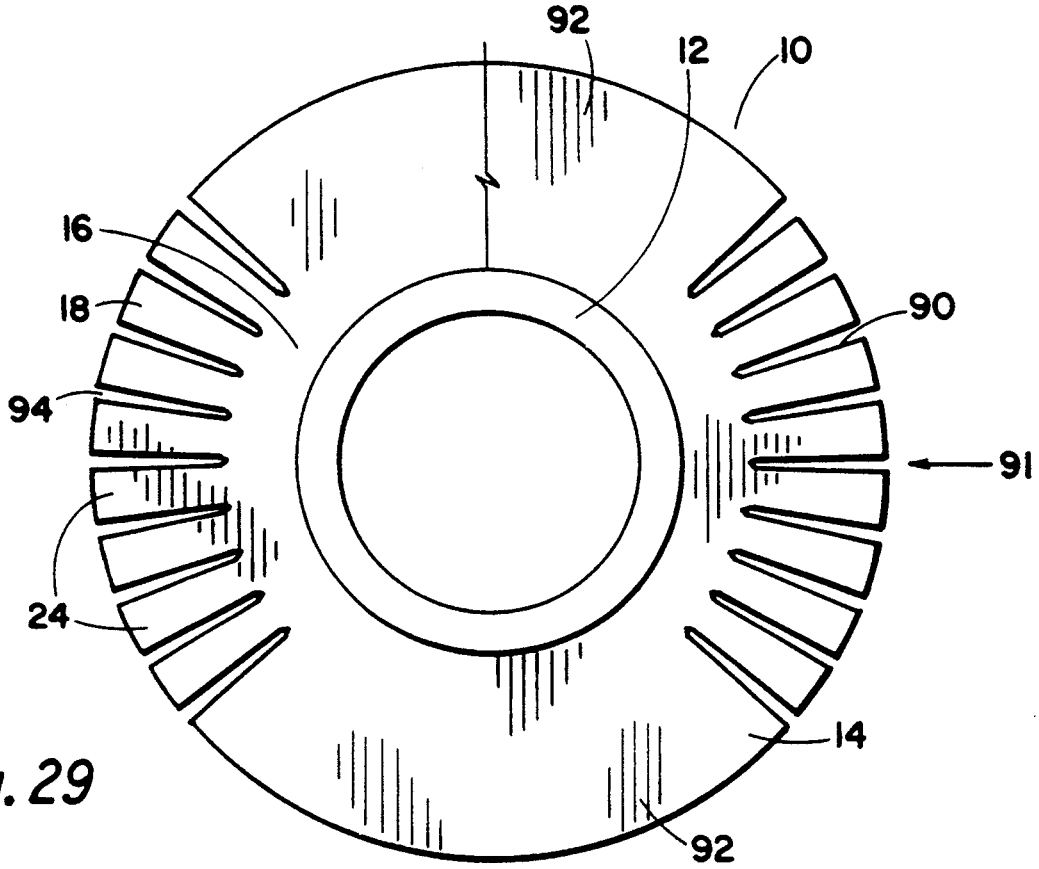
FIG. 29 is an end view of a finned tube with fins having three zones to accommodate heat transfer for three substantially different fluid flow conditions (indentation patterns are not shown).
Figure 30:
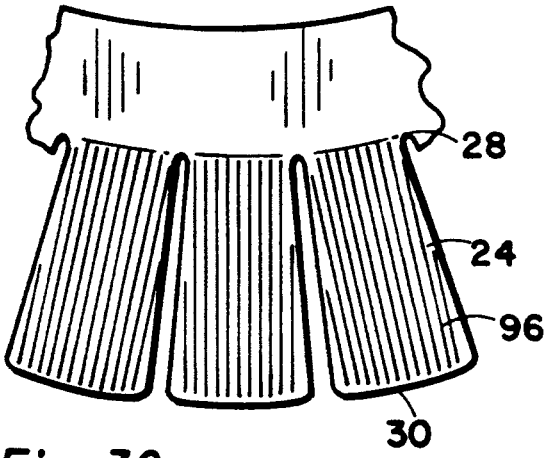
FIG. 30 is an enlarged top plan view of segments having a vertical ribbed pattern indentation impressed therein.

Referring now especially to FIGS. 29 and 30, the fins 14 on the tube 12 are configured to accommodate three substantially different flow conditions encountered by the finned tube 10. As best shown in FIG. 29, a first zone generally designated 90 is subjected to fluid flowing radially toward the finned tube 10 from the direction generally designated 91, or the upstream condition. A second zone generally designated 92, 92 is subjected to fluid flowing past the tube 12, or the sidestream condition and is both on the top and bottom sides of the tube 12 as it appears in FIG. 29. A third zone, generally designated 94 is subjected to fluid flowing radially away from the finned tube 10, or the downstream condition. Each flow condition is substantially different from the others, as will be more fully explained below. A fin 14 is configured differently at the above-defined zones 90, 92 and 94 to enhance heat transfer at the flow condition encountered at each zone.

In somewhat greater detail, fluid flow at zone 90, i.e., the upstream condition, is generally laminar and is at a higher pressure relative to flow at zones 92 and 94. A fin 14 in zone 90 may comprise a serrated portion 18; and the segments 24 of the serrated portion 18 can be provided with additional surface or texturization to increase heat transfer. At zone 90, the diamond pattern indentations 64, pin point pattern indentations 66, horizontal ribbed pattern indentations 68, pitted pattern indentations 70, and diagonal ribbed pattern indentations 72, as illustrated in FIGS. 20–24, are desirable. Additionally, the base portion 16 of the fin 14 at zone 90 experiences a high pressure and is texturized by toughening to improve heat transfer.

Fluid flow at zone 92 is generally in transition from substantially laminar to substantially turbulent flow. Perhaps a fin in zone 92 is desirably a plain spiral (non-serrated) fin to improve gas flow.

Fluid flow at zone 94 is generally turbulent and is at a low pressure relative to flow at zones 90 and 92. A fin 14 at zone 94 desirably comprises a serrated portion 18 with segments 24 embossed with a pattern such as vertical ribs which improve gas flow and reduce the pressure drop across the finned tube 10. Referring to FIG. 30, the top and bottom surfaces 32 and 34 of the segments 24 are impressed, respectively, with vertical pattern indentations 96, extending from the proximal area 28 of the segment 24 to the distal tip 30.

Figure 31:
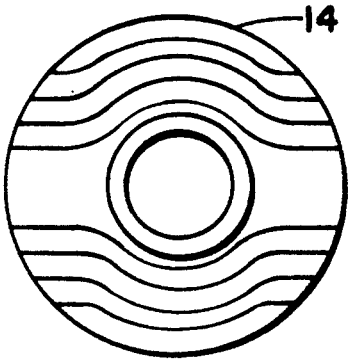
FIG. 31 is an end view of a fin embossed with a pattern to improve gas flow.

As shown in FIG. 31, a non-serrated fin 14', embossed with a pattern 98 illustrated in FIG. 31 is utilized to improve gas flow, i.e., lower pressure drop, across a finned tube 10. Alternatively, a non-circular fin (not illustrated) is utilized.

Figure 1:
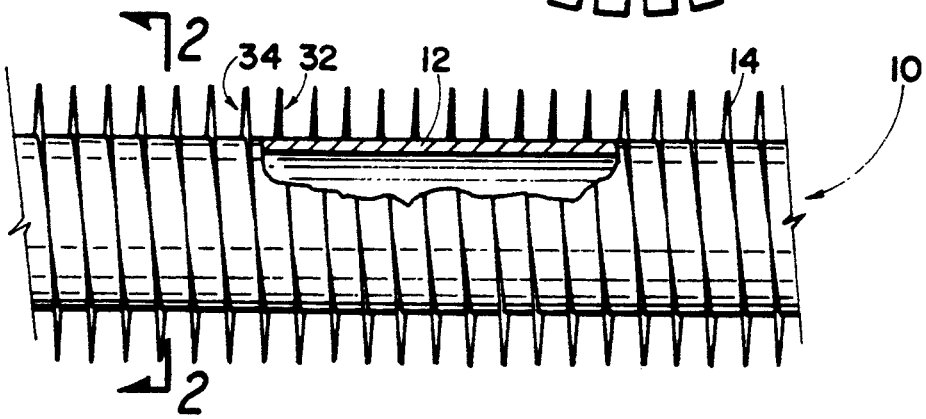
FIG. 1 is a side view of an enhanced serrated finned tube which can be used with the present invention.

FIGS. 1 through 28 disclose various enhanced serrated tubes; whereas the present invention is not directed to serrated finned tubes which is the claimed invention of the above-mentioned co-pending application, their inclusion herein is for the main purpose of illustrating the types of enhancements available for the present invention in the three different zones thereof. It should be understood that the three zones of the present invention are preferably provided with mutually different enhancements (or lack thereof). Thus, the different enhancements of FIGS. 1 to 28 are discussed as follows:

Referring to FIGS. 1 and 2, an enhanced serrated finned tube 10 is provided with a central hollow tube 12 with a fin 14 attached thereto, usually by welding and preferably by high frequency resistance welding. The fin 14 extends outwardly from and is within 15 degrees of perpendicular with the tube 12. The fin 14 is also wrapped helically around the tube 12 with adjacent spirals of the fin 14 spaced apart from each other. The fin 14 may be constructed of carbon steel, nickel alloys or other suitable material.

Figure 4:
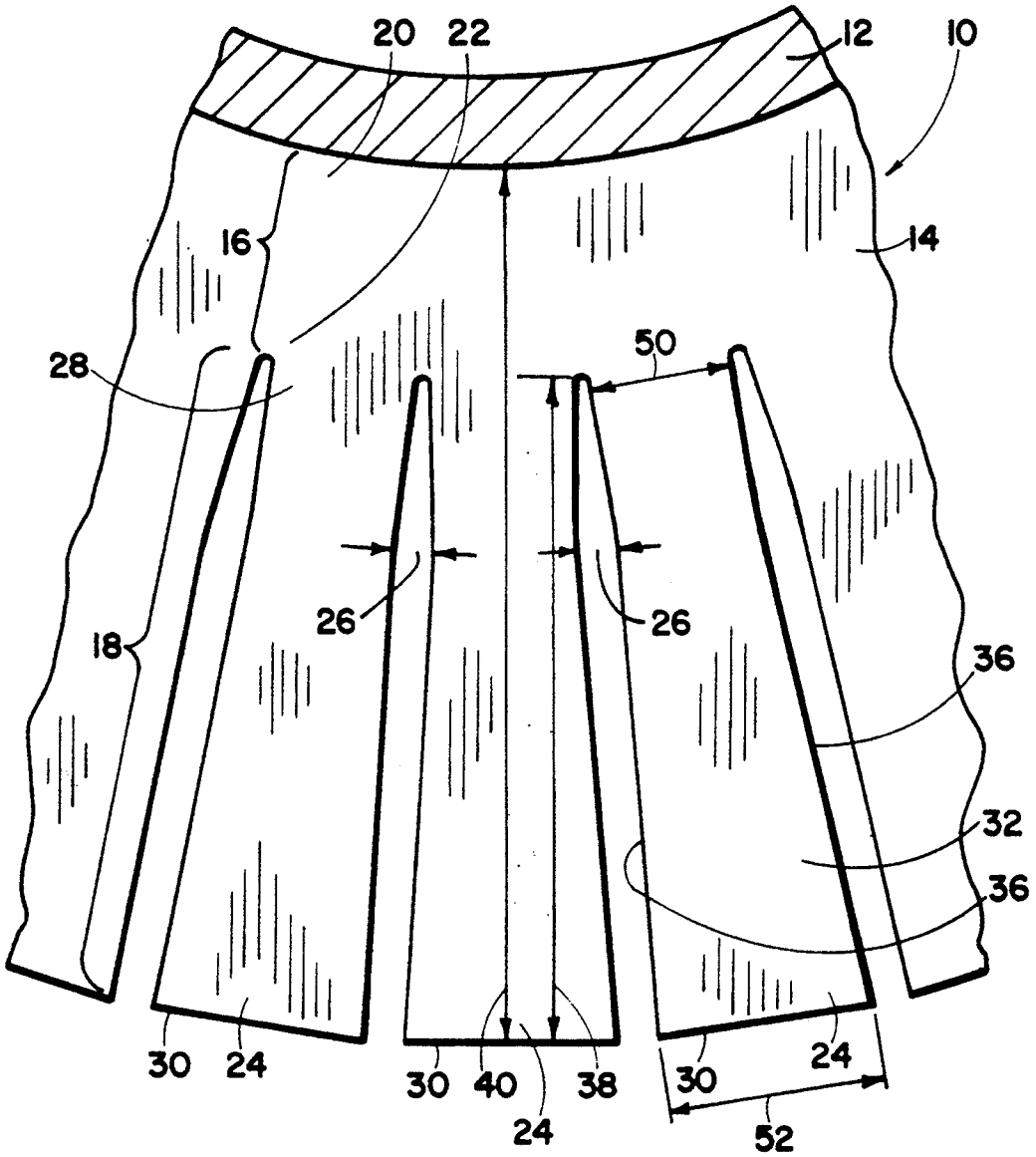
FIG. 4 is an enlarged partial view of the enhanced serrated finned tube shown in FIG. 2.

Referring now to FIG. 4, the fin 14 has a base portion 16 located adjacent to the tube 12 and a serrated portion 18 located adjacent to the base portion 16 and extending away from the tube 12. The base portion 16 is provided with a proximal edge 20 and an opposite distal area 22. The proximal edge 20 attaches to the tube 12 to secure the fin 14 thereto. The serrated portion 18 is provided with a multiplicity of segments 24, with adjacent segments 24 separated by gaps 26. Each segment 24 is provided with a proximal area 28 which is attached to the distal area 22 of the base portion 16, and with a distal tip 30 located opposite the proximal area 28. As shown in FIGS. 1 and 4, each segment 24 has a top surface 32 and a bottom surface 34 opposite the top surface 32, and two sides 36 located adjacent to the gaps 26 and on either side of the top and bottom surfaces 32 and 34.

Each segment 24 has a segment height 38 measured on the segment 24 from the proximal area 28 to the distal tip 30. Likewise, the fin 14 has a fin height 40 measured from the proximal edge 20 of the base portion 16 to the distal tip 30 of the segments 24.

Figure 8:
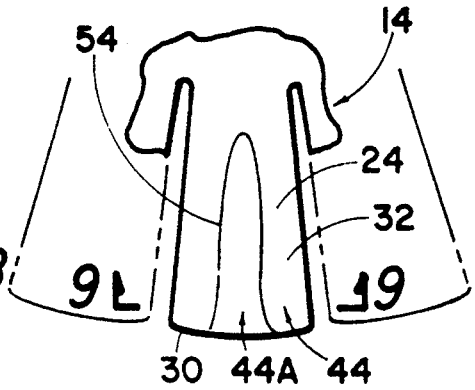
FIG. 8 is an enlarged top plan view of a single enhanced segment having a long tapered indentation.
Figure 10:
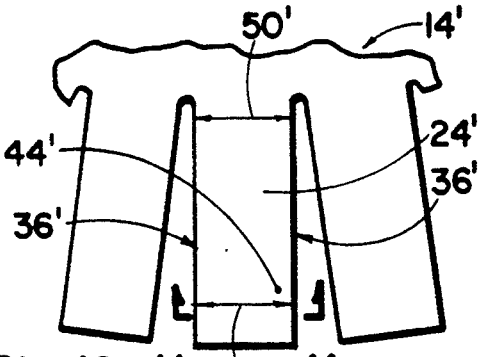
Fig.10 (PRIOR ART)
FIG. 10 is an enlarged top plan view of a prior art segment.
Figure 9:
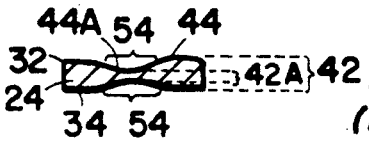
FIG. 9 is a cross-sectional view taken along line 9—9 of FIG. 8.

As illustrated in FIGS. 8 and 9, each segment 24 has at least one segment depth 42; each segment depth 42 is measured from a point 44 on the top surface 32 of the segment 24, through the segment 24, i.e. from the top surface 32 to the bottom surface 34, perpendicularly to the segment height 38.

Obviously, if the top surface 32 and the bottom surface 34 are not parallel with each other, the segment depth 42 can vary depending upon which point 44 was selected for measuring the segment depth 42. As will become apparent, certain embodiments of the enhanced serrated finned tube 10 have segments 24 with top surfaces 32 and bottom surfaces 34 which are not parallel.

Figure 5:
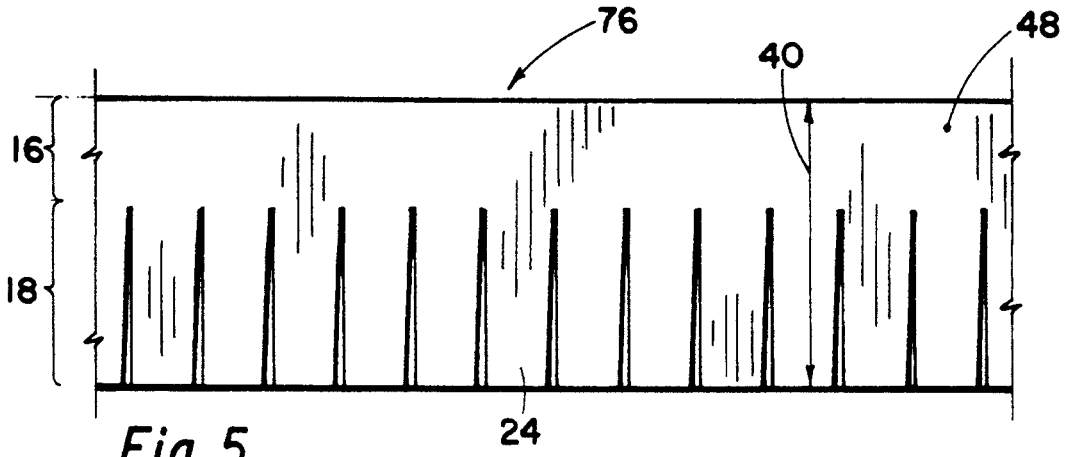
FIG. 5 is a top plan view of a serrated fin strip as it appears prior to being enhanced.
Figure 6:
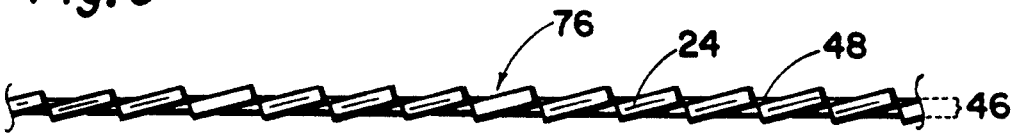
FIG. 6 is a front elevation of the serrated fin strip shown in FIG. 5.

Referring now to FIGS. 5 and 6, the base portion 16 has at least one base portion depth 46; each base portion depth 46 is measured from a spot 48 on the base portion 16, through the base portion 16 perpendicularly to the fin height 40.

Referring now to FIG. 4, each segment 24 also has a proximal width 50 measured between the two sides 36 at the proximal area 28 of the segment 24 and a distal width 52 measured between the two sides 36 at the distal tip 30 of the segment 24.

Referring now to FIGS. 2, 3, 4, 8, 9 and 10, differences are illustrated between the enhanced serrated finned tube 10 and a prior art serrated fin tube, generally designated by numeral 10'. Similar to the enhanced serrated finned tube 10, the prior art serrated finned tube 10' is provided with all of the same features as previously described for the enhanced serrated finned tube 10; said features will be hereinafter referred to by designating the numeral of the same feature on the enhanced serrated finned tube 10, followed by a prime '/' symbol. For example, 12' is a central hollow tube provided on the prior art serrated finned tube 10' which corresponds with the central hollow tube 12 on the enhanced serrated finned tube 10.

First, the segments 24' of the prior art finned tube 10' have two sides 36' which are parallel with each other, and therefore, the segments 24' have distal widths 52' and proximal widths 50' which are equal to each other. This differs from the segments 24 of the enhanced serrated finned tube 10 which has distal widths 52 greater than its proximal widths 50. Widths 50 and 52 are not equal because the segments 24 have been enhanced and thus broadened.

Enhancing the segments 24 also produces a second difference in the enhanced serrated finned tube 10 with respect to the prior art serrated finned tube 10'. The second difference relates to the top and bottom surfaces 32 and 34 of the enhanced serrated finned 10 as compared to the top and bottom surfaces 32' and 34∝ of the prior art serrated finned tube 10'.

Figure 11:
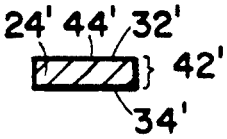
Fig.11 (PRIOR ART)
FIG. 11 is a cross-sectional view taken along line 11—11 of FIG. 10.

Referring now to FIG. 11, there is shown a cross-sectional view through the segment 24' of the prior art fin 14'. The top and bottom surfaces 32' and 34' are parallel with each other and the segment depth 42' is the same regardless of which point 44' on the top surface 32' is chosen. However, as illustrated in FIG. 9, for example, the same is not true for the enhanced serrated fin 14 of the enhanced serrated finned tube 10. Depending on whether point 44 or an alternate point 44A on the top surface 32 is chosen, the segment depth 42 and an alternate segment depth 42A are not the same.

The fin 14 of the enhanced serrated finned tube 10 shown in FIGS. 8 and 9 is provided with a long, tapered indentation 54 impressed into both the top and bottom surfaces 32 and 34. By enhancing the fin 14 with the indentation 54, the segments 24 are thus broadened and their surface area is increased. Many patterns and designs are possible as indentations 54. A few possible embodiments are illustrated and discussed below.

Figure 12:
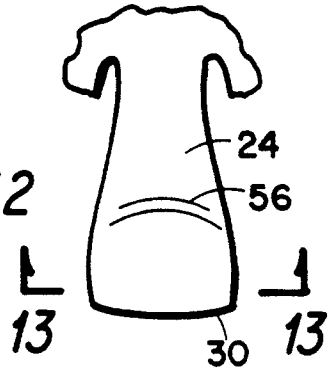
FIG. 12 is an enlarged top plan view of a single enhanced segment having a broad flat indentation.
Figure 13:
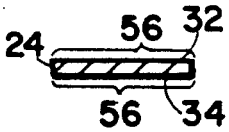
FIG. 13 is a cross-sectional view taken along line 13—13 of FIG. 12.

FIGS. 12 and 13 illustrate another embodiment wherein a broad flat indentation 56 is impressed into both the top and bottom surfaces 32 and 34 at the distal tip 30 of the segment 24.

Figure 14:
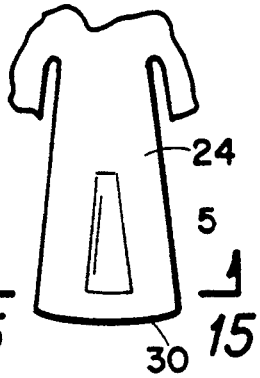
FIG. 14 is an enlarged top plan view of a single enhanced segment having a central triangular indentation.
Figure 15:
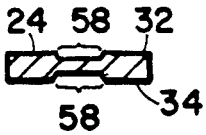
FIG. 15 is a cross-sectional view taken along line 15—15 of FIG. 14.

FIGS. 14 and 15 illustrate another embodiment wherein a central triangular indentation 58 is impressed into both the top and bottom surfaces 32 and 34.

Figure 16:
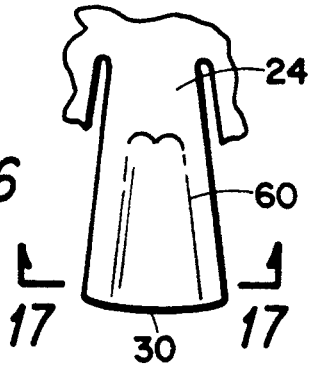
FIG. 16 is an enlarged top plan view of a single enhanced segment having a long, double tapered indentation.
Figure 17:
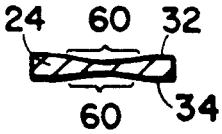
FIG. 17 is a cross-sectional view taken along line 17—17 of FIG. 16.

FIGS. 16 and 17 illustrate an additional embodiment wherein a long, double tapered indentation 60 is impressed into both the top and bottom surfaces 32 and 34.

Figure 18:
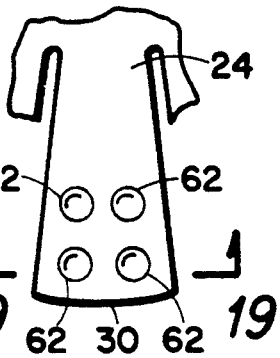
FIG. 18 is an enlarged top plan view of a single enhanced segment having dotted indentations.
Figure 19:
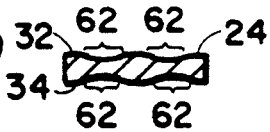
FIG. 19 is a cross-sectional view taken along line 19—19 of FIG. 18.
Figure 20:
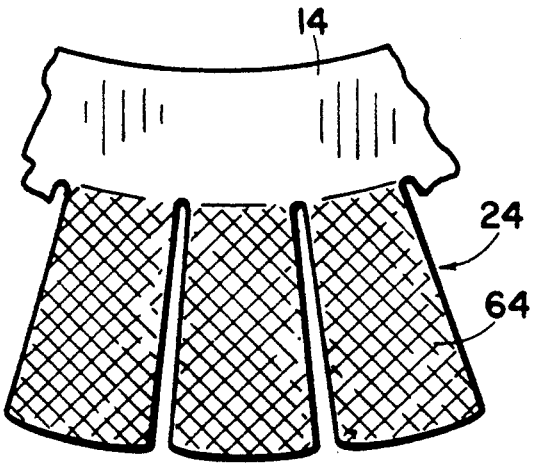
FIG. 20 is an enlarged top plan view of segments having a diamond pattern indentation impressed therein.
Figure 21:
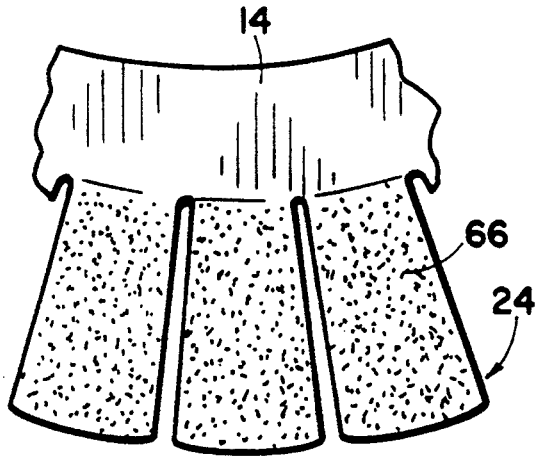
FIG. 21 is an enlarged top plan view of segments having a pin point pattern indentation impressed therein.
Figure 22:
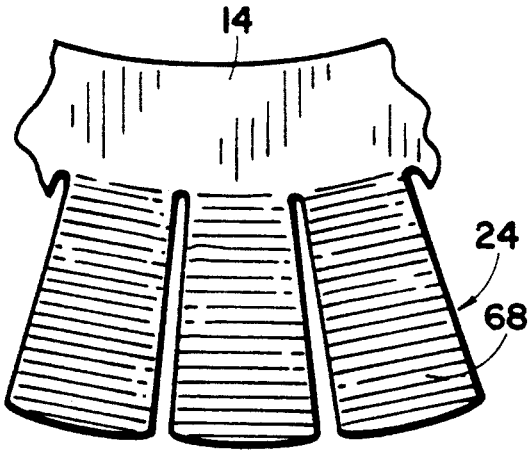
FIG. 22 is an enlarged top plan view of segments having a horizontal ribbed pattern indentation impressed therein.
Figure 23:
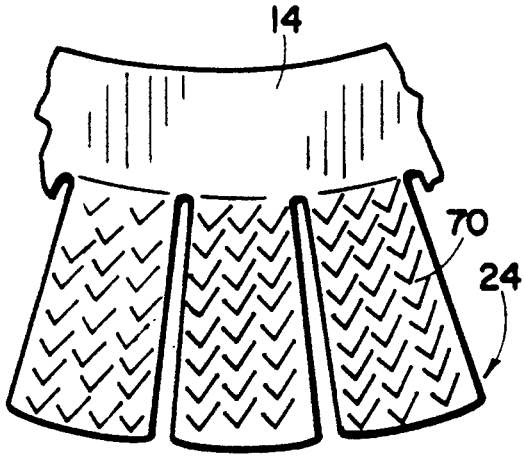
FIG. 23 is an enlarged top plan view of segments having a pitted pattern indentation impressed therein.
Figure 24:
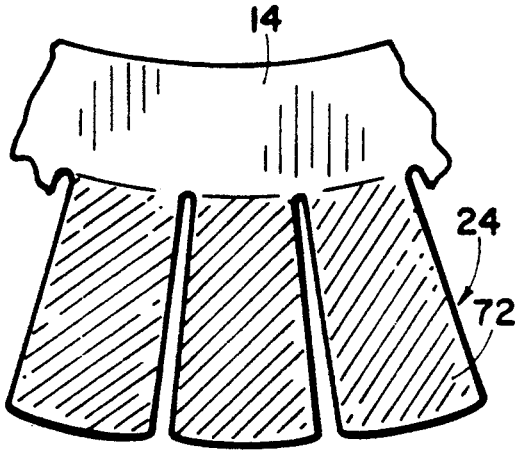
FIG. 24 is an enlarged top plan view of segments having a diagonal ribbed pattern indentation impressed therein.

FIGS. 18 and 19 illustrate another embodiment wherein dotted indentations 62 are impressed into both the top and bottom surfaces 32 and 34.

FIGS. 20, 21, 22, 23, and 24 illustrate still other embodiments wherein the top and bottom surfaces 32 and 34 are impressed, respectively, with diamond pattern indentations 64, pin point pattern indentations 66, horizontal ribbed pattern indentations 68, pitted pattern indentations 70, and diagonal ribbed pattern indentations 72.

Figure 25:
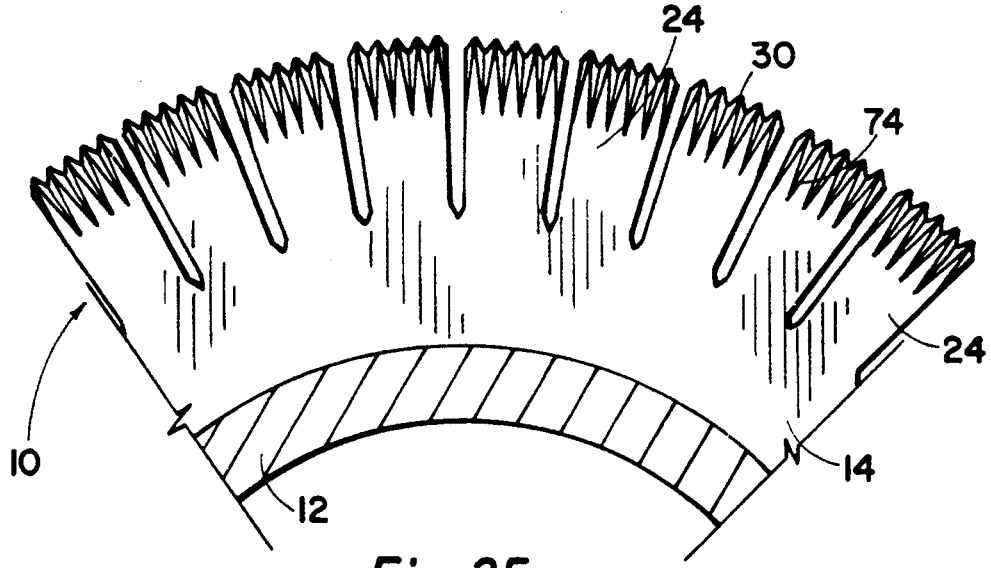
FIG. 25 is an enlarged top plan view of segments having jagged, grooved indentations provided at the distal tip of the fin.

FIG. 25 illustrates another embodiment wherein the distal tips 30 of the segments 24 are impressed with jagged, grooved indentations 74.

As an example of the amount of increase in surface area attainable, the following percentages of surface area enhancement are attained utilizing a 2 inch tube 12, various fin heights 40, a base portion depth 46 of 18 gauge metal, a 0.172 inch proximal width 50, and various distal widths 52. The data listed below is attained for pie serrated fins 14 which are spaced five (5) fins 14 per inch of tube 12.

| Fin Height | Distal Width of Segments | Surface Area Increase (In Percentage) |
|---|---|---|
| 1 inch | 0.256 inches | 13.9 |
| ⅞ inch | 0.237 inches | 10.2 |
| ¾ inch | 0.218 inches | 6.7 |

Figure 7:
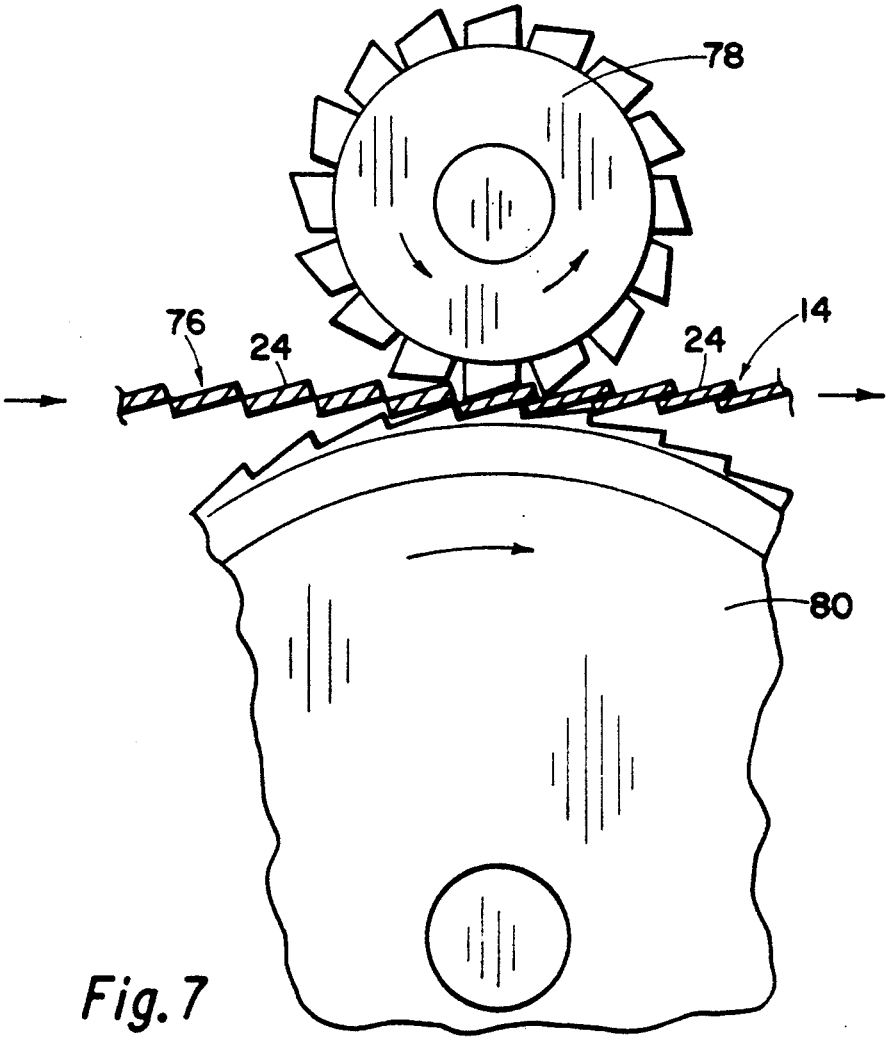
FIG. 7 is a front elevation of the serrated fin strip shown in FIG. 6 illustrating a method for enhancing the serrated fin strip.

Referring now to FIGS. 5, 6 and 7 there is illustrated one method for producing the fin 14, i.e. enhancing after serrating and prior to the fin 14 being attached to the tube 12. FIGS. 5 and 6 illustrate a straight piece of unenhanced serrated fin strip 76. Prior to enhancement, the base portion depth 46 and the segment depths 42 are all equal to each other. FIG. 7 shows how the unenhanced serrated fin strip 76 passes between enhancing tools 78 and 80 and emerges as enhanced serrated fin 14 which is ready to be attached to the tube 12 to form the enhanced serrated finned tube 10. If the base portion 16 is not enhanced, the base portion depth 46 will remain unaltered after enhancement. If the segments 24 are enhanced, their segment depths 42 and 42A will differ from the base portion depth 46 and possibly differ from each other, depending on which points 44 or 44A are selected.

Figure 26:
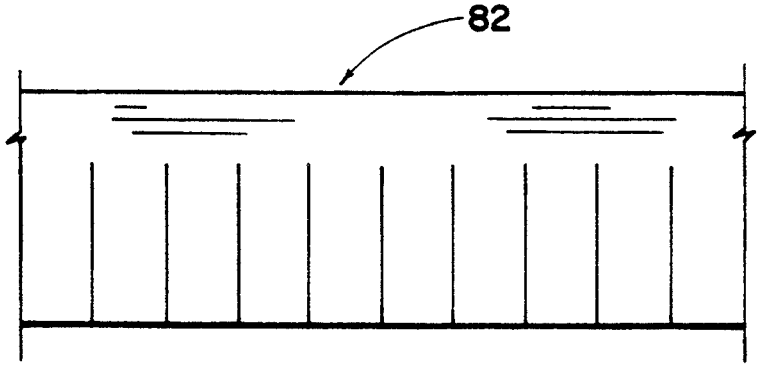
FIG. 26 is a top plan view of a unserrated enhanced fin strip with undulations impressed therein.
Figure 27:
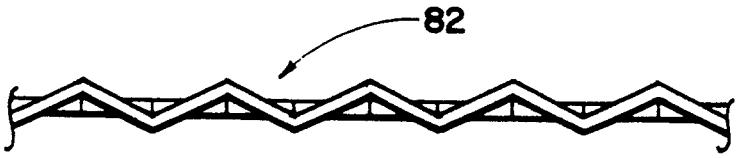
FIG. 27 is a front elevation of the unserrated enhanced fin strip illustrated in FIG. 26.
Figure 28:
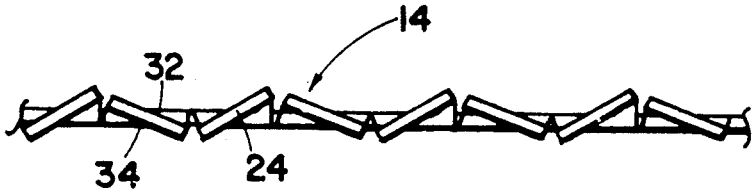
FIG. 28 is a front elevation of the unserrated enhanced fin strip of FIG. 27 as it appears after being serrated.
Figure 32:
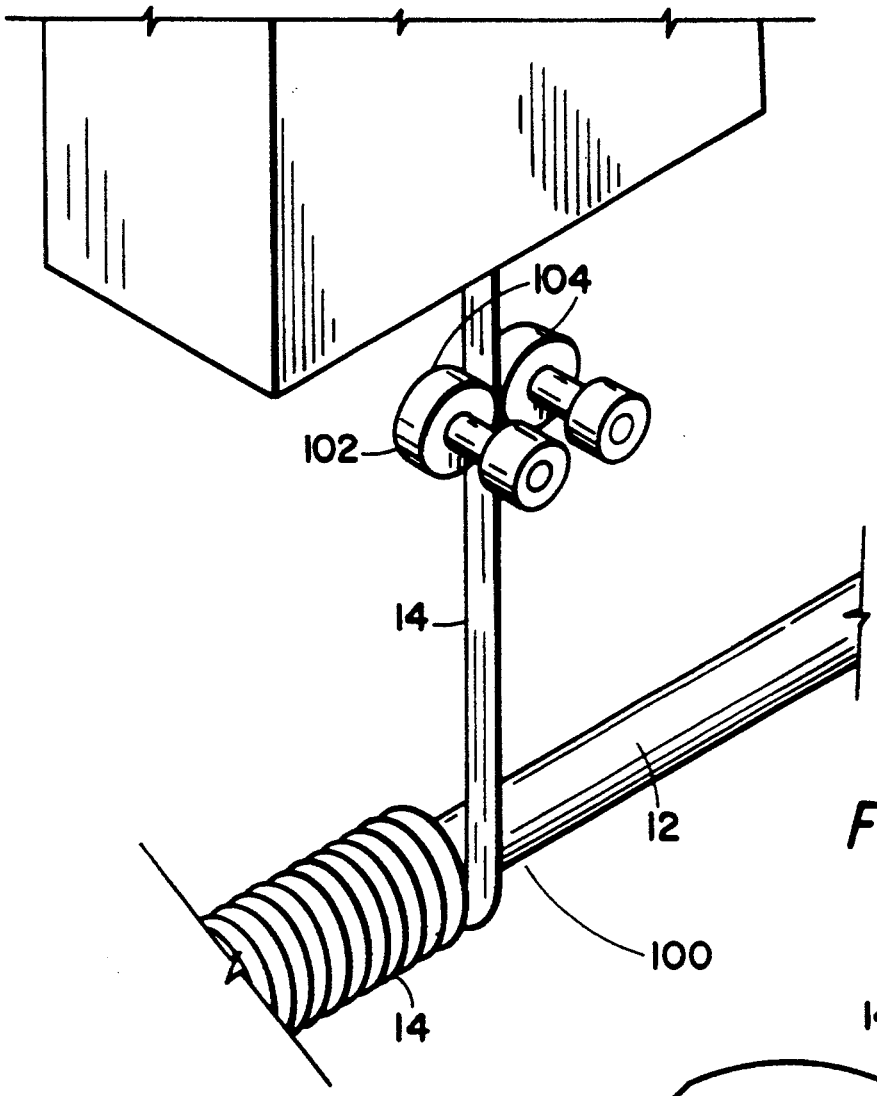
FIG. 32 is a sketch of a commercial finning process accompanied by a fin material embossing machine suitable for producing the finned tube illustrated in FIG. 29.

Alternately, another method for producing the fin 14, i.e. enhancing prior to serrating, is illustrated in FIGS. 26, 27 and 28. FIGS. 26 and 27 show a straight piece of unserrated enhanced fin strip 82. FIG. 28 shows the same strip 82 after being serrated to form enhanced serrated fin 14 which is ready to be attached to the tube 12 to form the enhanced serrated finned tube 10.

Where fins 14 on a tube 12 are configured to accommodate the at least three substantially different flow conditions encountered by the finned tube 10, the fin enhancements can be added to the fins during a commercial firming process generally designated 100, as shown in FIG. 32. The finning process 100 is accompanied by a texturizing or fin material embossing machine 102.

In somewhat greater detail, a commercial finning process 100 comprises helically wrapping a strip or fin 14 around and at an angle to a tube 12 and attaching the strip 14 to the tube 12, preferably by high frequency welding, to form the fins 14 thereon.

The embossing machine 102, which comprises two embossing rolls 104, is electrically or mechanically linked to the tube 12. The rotation rates of the tube 12 and embossing rolls 104 are related by a ratio of whole numbers so that a pattern is repeated each resolution of the tube 12. For example, the tube 12 is rotated at a rate of 600 r.p.m. while the embossing rolls 104 are rotated at a rate of 300 r.p.m., a ratio of 2:1.

Figure 33:
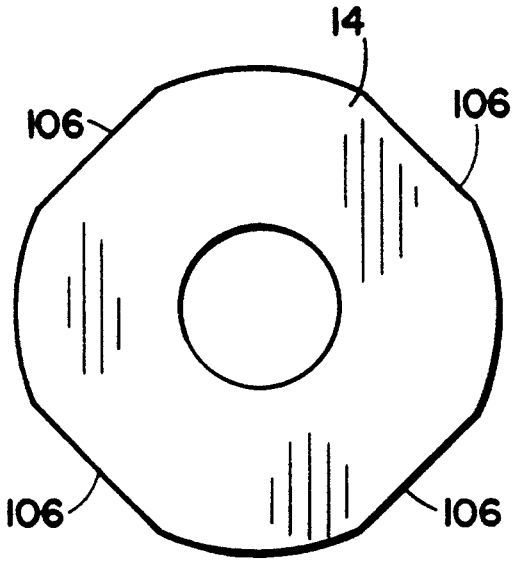
FIG. 33 is an end view of an embossing roll of the present invention having flat spots thereon.

In a particular embodiment of this invention, the tolerance in the whole number ratio is adjusted by flat spots 106 on the embossing rolls 104. The flat spots 106 allow slippage to adjust for minimal variations in the tube 12 rotation rate due to tooling diameter wear or the effect of metal changes impacting the fin material neutral axis. FIG. 33 illustrates a specific embodiment of an embossing roll 104 having four substantially equally spaced apart flat spots 106 thereon. The aforementioned specific embodiment is provided as an example and is not intended to be limiting. The number of and spacing between flat spots 106 on an embossing roll 104 are based on strip material of composition and other engineering design considerations.

While a plurality of methods have been described above for producing the fin 14 and the finned tube 10, the present invention is not limited to these methods of production.

Whereas, the present invention has been disclosed in terms of the specific structure described above, it should be understood that other and further modifications, apart from those shown or suggested herein, may be made within the spirit and scope of this invention.

What is claimed is:

1. An enhanced finned tube comprising:

a fin having a base portion and an opposite tip portion, the base portion being provided with a proximal edge and an opposite distal area, the proximal edge being attached helically to a tube so the fin extends outwardly from the tube, the distal area being attached to the tip portion, wherein the fin has at least three zones, each said zone being configured to enhance heat transfer for the fluid flow condition encountered at that zone when the finned tube is in use in a heat exchange process, wherein the zones comprise an upstream zone which encounters fluid flowing toward the finned tube, a sidestream zone which encounters fluid flowing past the finned tube, and a downstream zone which encounters fluid flowing away from the finned tube, and wherein the tip portion of the upstream zone is serrated into segments provided with indentations to increase the surface area of the segments.

2. An enhanced finned tube according to claim 1 wherein the tip portion of the downstream zone is serrated into segments provided with vertical pattern indentations to improve gas flow.

3. An enhanced finned tube according to claim 1 wherein the tip portion of the sidestream zone is plain spiral fin material.

4. An enhanced finned tube comprising:

a fin having a base portion and an opposite tip portion, the base portion being provided with a proximal edge and an opposite distal area,, the proximal edge being attached helically to a tube so the fin extends outwardly from the tube, the distal area being attached to the tip portion, wherein the fin has at least three zones, each said zone being configured to enhance heat transfer for the fluid flow condition encountered at that zone when the finned tube is in use in a heat exchange process, wherein the zones comprise an upstream zone which encounters fluid flowing toward the finned tube, a sidestream zone which encounters fluid flowing past the finned tube, and a downstream zone which encounters fluid flowing away from the finned tube, and wherein the tip portion of the downstream zone is serrated into segments provided with vertical pattern indentations t improve gas flow.

5. An enhanced finned tube according to claim 4 wherein the tip portion of the sidestream zone is plain spiral fin material.

6. An enhanced finned tube comprising:

a fin having a base portion and an opposite tip portion, the base portion being provided with a proximal edge and an opposite distal area, the proximal edge being attached helically to a tube so the fin extends outwardly from the tube, the distal area being attached to the tip portion, wherein the fin has at least three zones, each said zone being configured to enhance heat transfer for the fluid flow condition encountered at that zone when the finned tube is in use in a heat exchange process, wherein the zones comprise an upstream zone which encounters fluid flowing toward the finned tube, a sidestream zone which encounters fluid flowing past the finned tube, and a downstream zone which encounters fluid flowing away from the finned tube, and wherein the tip portion of the sidestream zone is plain spiral fin material.

7. An enhanced finned tube according to claim 6 wherein the upstream and downstream zones are embossed.

* * * * *